US011027896B2

(12) United States Patent
Boulais

(10) Patent No.: US 11,027,896 B2
(45) Date of Patent: Jun. 8, 2021

(54) FLUID DISPENSER

(71) Applicant: GB DEVELOPPEMENT, Vernon (FR)

(72) Inventor: Guillaume Boulais, Levallois Perret (FR)

(73) Assignee: GB DEVELOPPEMENT, Vernon (FR)

( * ) Notice: Subject to any disclaimer, the term of this patent is extended or adjusted under 35 U.S.C. 154(b) by 0 days.

(21) Appl. No.: 16/603,161

(22) PCT Filed: Apr. 4, 2018

(86) PCT No.: PCT/EP2018/058610
§ 371 (c)(1),
(2) Date: Oct. 4, 2019

(87) PCT Pub. No.: WO2018/185165
PCT Pub. Date: Oct. 11, 2018

(65) Prior Publication Data

US 2020/0031537 A1 Jan. 30, 2020

(30) Foreign Application Priority Data

Apr. 6, 2017 (FR) ..... 1753003

(51) Int. Cl.
*B65D 47/20* (2006.01)
*B65D 35/12* (2006.01)
*B65D 83/00* (2006.01)

(52) U.S. Cl.
CPC ..... *B65D 47/2068* (2013.01); *B65D 35/12* (2013.01); *B65D 83/0094* (2013.01)

(58) Field of Classification Search
CPC . B65D 47/2068; B65D 35/12; B65D 83/0094
(Continued)

(56) References Cited

U.S. PATENT DOCUMENTS 2,107,106 A * 2/1938 Crook ..... B65D 35/20 222/494
2,589,743 A * 3/1952 Snaith ..... B65D 35/22 222/94

(Continued)

OTHER PUBLICATIONS

International Search Report for corresponding Application No. PCT/EP2018/058610, dated Aug. 9, 2018.

*Primary Examiner* — Donnell A Long
(74) *Attorney, Agent, or Firm* — Renner, Otto, Boisselle & Sklar, LLP

(57) ABSTRACT

A fluid dispensing device including a deformable chamber having an interior volume arranged to contain a fluid, and a dispensing valve for opening and closing an outlet in fluid communication with the interior volume of the deformable chamber. The dispensing valve includes a pin and a movable member. The pin has and end which, in the closed state of the dispensing valve, closes the outlet of the chamber and in the open state of the dispensing valve, deviates from the outlet of the chamber, the movable member being arranged to move under the effect of a decrease of the interior volume of the chamber or an overpressure from the fluid in the interior volume of the chamber above a certain threshold so as to move the pin away from the outlet of the chamber so as to move the dispensing valve from its closed state to its open state.

22 Claims, 7 Drawing Sheets

Figure 1:
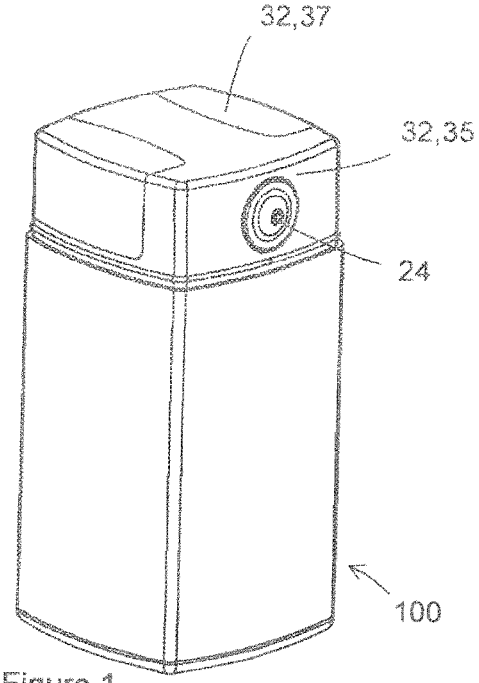

(58) Field of Classification Search
USPC ..... 222/518, 495, 496
See application file for complete search history.

(56) References Cited

U.S. PATENT DOCUMENTS 4,776,495 A * 10/1988 Vignot ..... A47K 5/1209
222/206
5,377,880 A * 1/1995 Moretti ..... B05B 11/0072
222/207
5,862,955 A * 1/1999 Albini ..... B05B 11/3032
222/212
5,971,224 A * 10/1999 Garibaldi ..... B05B 11/3032
222/207
6,971,553 B2 * 12/2005 Brennan ..... B05B 11/3077
222/207
7,997,453 B1 * 8/2011 Gallegos ..... A45D 34/04
222/207
8,695,856 B2 * 4/2014 Nilsson ..... A47K 5/1209
222/207

* cited by examiner

FLUID DISPENSER

TECHNICAL FIELD

The present invention relates to a device for dispensing a fluid.

The field of the invention is more particularly that of the distribution of fluids such as liquids, gels or creams, for example for the pharmaceutical or cosmetic or agri-food industry.

STATE OF THE ART

Devices for dispensing fluids comprising:

- a chamber on which the user can press,
- a reservoir,
- a dispensing valve for the outlet of the fluid from the chamber towards the outside of the device,
- a feed valve for the passage of fluid from the reservoir to the chamber.

Devices according to the state of the art can pose certain problems.

A first problem is the rigidity of the dispensing valve: the dispensing valve must at the same time make it possible to close the device (to avoid loss or drying of the fluid) and must not be too difficult to open, for example when a single finger of a user presses on the chamber.

A second problem is the storage of the fluid of the chamber in particular to not denature the composition of the fluid and/or to avoid possible wear or chemical attack of the walls of the chamber by the fluid.

A third problem is the simplicity of manufacture of the device and/or the reduction in the number of parts making up the device.

The object of the present invention is to solve at least one of the above-mentioned problems.

DISCLOSURE OF THE INVENTION

According to a first aspect of the invention, there is provided a dispensing device, comprising:

- a deformable chamber whose internal volume is arranged to contain a fluid, the deformable chamber being provided with an outlet,
- a dispensing valve which, in an open state, allows a passage of fluid from the interior of the chamber to the outside of the device through the outlet of the chamber and, in a closed state, does not allow it.

The dispensing valve may comprise a pin and a movable member, the pin having an end which:

- in the closed state of the dispensing valve, closes the outlet of the chamber and
- in the open state of the dispensing valve deviates from the outlet of the chamber the movable member being arranged to move under the effect of a decrease in the internal volume of the chamber or an overpressure of the fluid in the interior volume of the chamber above a certain pressure threshold so as to move the pin by moving it away from the outlet of the chamber so as to move the dispensing valve from its closed state to its open state.

The movable member may comprise at least one movable wall of at least one gas pocket, each gas pocket containing a gas without being able to exit this pocket and being arranged to isolate this gas with respect to the fluid contained in the deformable chamber.

The movable wall of each gas pocket may have a contact surface arranged to be in full contact with the fluid contained in the chamber.

The area of the contact area of the gas pocket or the sum of the areas of the contact surfaces of the gas pockets may be at least thirty-five times (preferably at least forty-five times) greater than a minimum area of fluid passage through the outlet of the chamber.

The area of the contact surface of the gas pocket or the sum of the areas of the contact surfaces of the gas pockets may be at least 50 $mm^2$ or even at least 70 $mm^2$ or even at least 90 $mm^2$.

At least one or each contact surface may be convex on the side of the fluid contained in the deformable chamber.

The device according to this first aspect of the invention may comprise several movable walls of several gas pockets aligned along an axis of elongation of the pin.

The pressure inside each gas pocket may be equal to or substantially equal (±10%) to one atmosphere, or greater than one atmosphere.

The dispensing valve (and preferably also the at least one gas pocket) may be part of a module inserted into the device from outside or inside the device and preferably ultrasonically welded.

The module may comprise a double wall and may be fixed to the rest of the device according to the invention, preferably to the cap, by clamping between the two walls (which preferably surround the pin) of this double wall.

The module or the chamber may comprise a protruding part towards the outlet and extending over a length of at least 3 mm.

The outlet may be delimited by a periphery comprising a part called flexible part and a part called rigid part in a more rigid material than the flexible part, the rigid part being closer to the outside of the deformable chamber than the flexible part. In the closed position of the dispensing valve, the end of the pin may be in contact with the flexible part in a first contact line. In the closed position of the dispensing valve, the end of the pin can be further in contact with the rigid part in a second contact line. The pin is preferably more rigid than the flexible part and the rigid part.

Preferably, the pin is flush or protrudes less than 1 mm from the outlet.

The pin and/or the movable member may be arranged to be in contact with the fluid contained in the deformable chamber.

The device according to the first aspect of the invention may comprise at least one return means arranged to exert on the pin a return force so as to push the pin towards the outlet of the chamber so as to bring back the dispensing valve from its open position to its closed position.

The at least one return means may comprise at least one or each movable wall of gas pocket.

The at least one return means may comprise, for the gas pocket or for at least one of the gas pockets or for each gas pocket, a spring inside this gas pocket and in contact with the movable wall of this gas pocket.

The dispensing valve can be:

- partially contained within the deformable chamber in the closed position of the dispensing valve, and/or
- entirely within the deformable chamber in the open position of the dispensing valve.

According to a second aspect of the invention that is independent but possibly combinable with the first aspect of the invention, there is provided a dispensing device, comprising:

- a cap comprising an insertion orifice,
- a stopper, the cap and the stopper being arranged so that the stopper is mounted in the cap according to an insertion assembly in the cap on the side of the insertion orifice, the device comprising a deformable chamber whose interior volume is arranged to contain a fluid, said chamber being provided with an inlet so that the device is arranged to conduct a fluid along a circulation path of fluid from the inlet then through the chamber and to an outlet, the device comprising a part called pressing part (which is preferably a deformable wall and/or flexible surface) arranged to be movable so as to modify this interior volume.

The device according to the second aspect of the invention may further comprise a chamber film delimiting at least in part the internal volume of the deformable chamber and arranged to be in contact with the pressing part of the cap.

The chamber film may be arranged to position itself between the fluid contained in the deformable chamber and the cap so that the cap is not in contact with the fluid contained in the chamber.

The device according to the second aspect of the invention may further comprise, inside the chamber, a return means arranged to exert on the chamber film a return force pushing the chamber film against the pressing surface.

The chamber film may be welded to the stopper.

The chamber film may be clamped between the cap and the stopper.

The stopper may comprise an elongated member provided with two ends, each of these ends having a periphery in contact with the chamber film so that, for each periphery, the chamber film is located between this periphery and the cap.

Independently but possibly combinable with the chamber film, the device according to the second aspect of the invention may further comprise at least one reservoir film, extending towards outside of the cap so as to form a reservoir of fluid in communication with the deformable chamber through the entrance.

The at least one reservoir film can be held by a force exerted by the stopper on the cap.

The device according to the second aspect of the invention may comprise, among the at least one reservoir film, a reservoir film which can be clamped between the stopper and the cap.

The device according to the second aspect of the invention may comprise, among the at least one reservoir film, a reservoir film that can be held between two walls of the cap, these two walls being arranged to come closer to pinch the reservoir film after insertion of the stopper into the cap under the action of the force exerted by the stopper on the cap.

The chamber film and at least one among the at least one reservoir film may be the same film.

The stopper may be arranged to slide inside the cap with a sealing junction between the stopper and the cap over a length of at least 5 mm and even at least 6 mm and even at least 10 mm and even at least 15 mm.

DESCRIPTION OF FIGURES AND EMBODIMENTS

Figure 5:
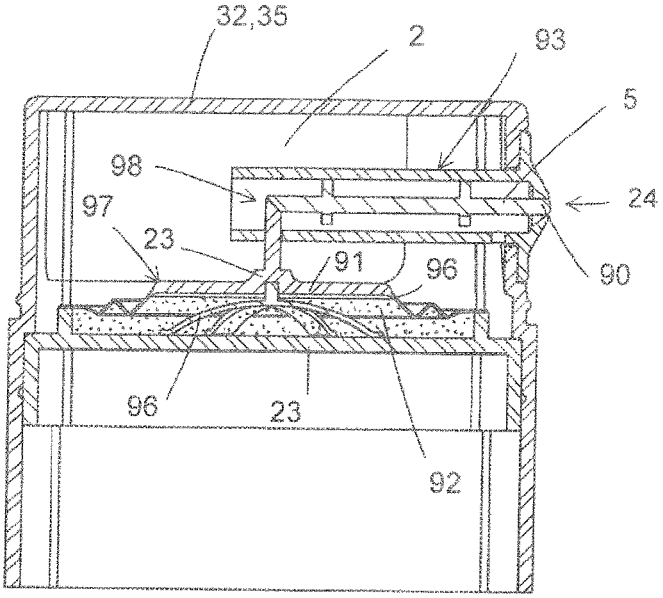
Figure 3:
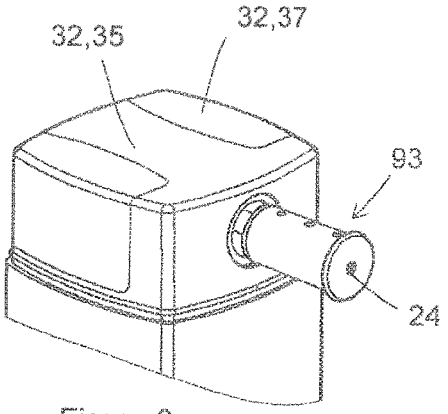
Figure 2:
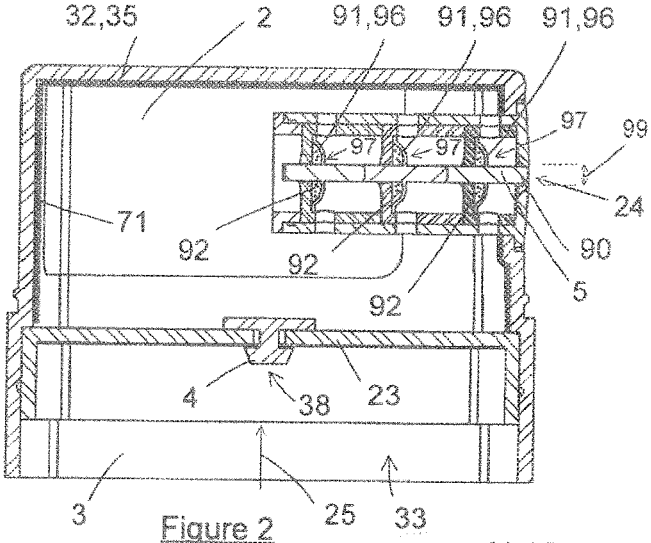
Figure 4:
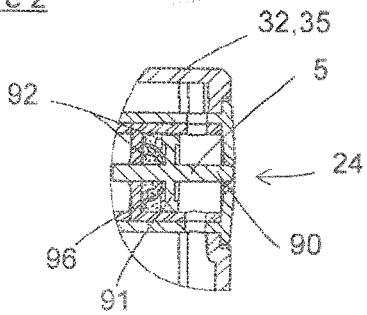
Figure 6:
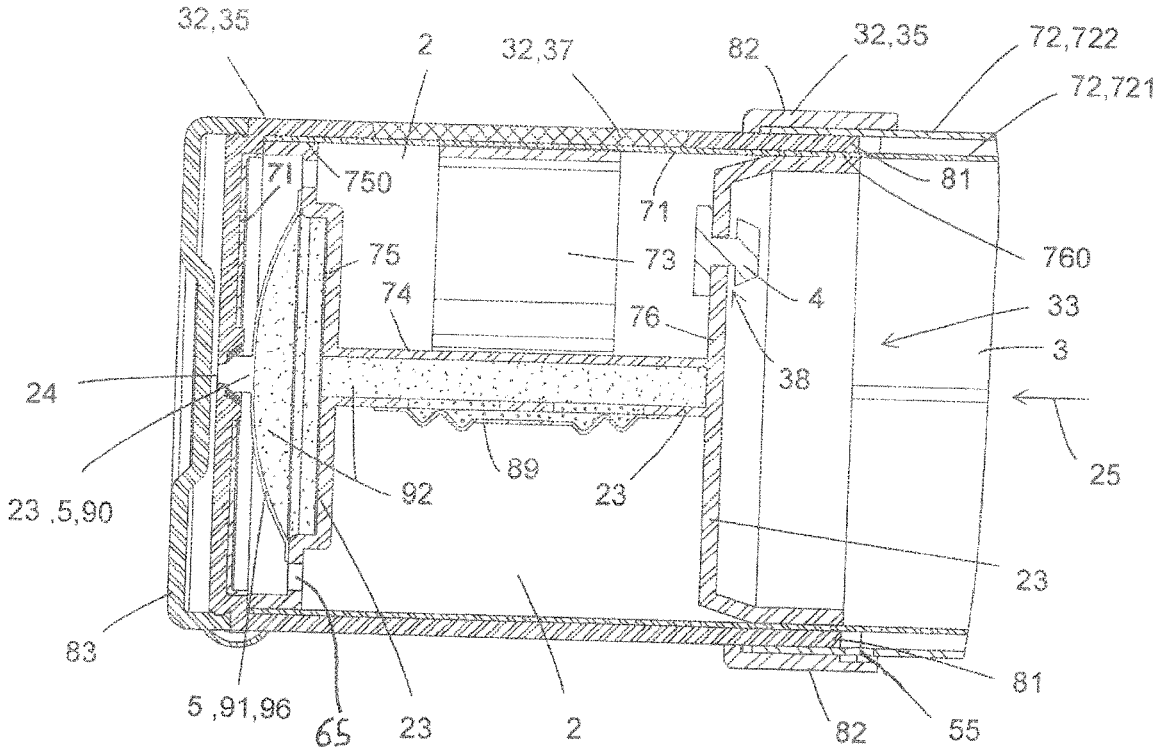
Figure 7:
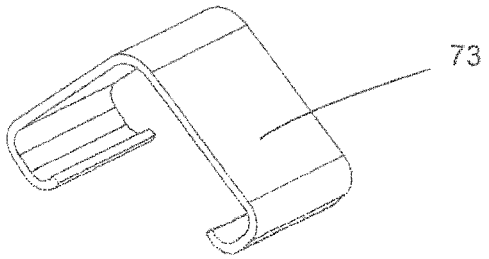
Figure 8:
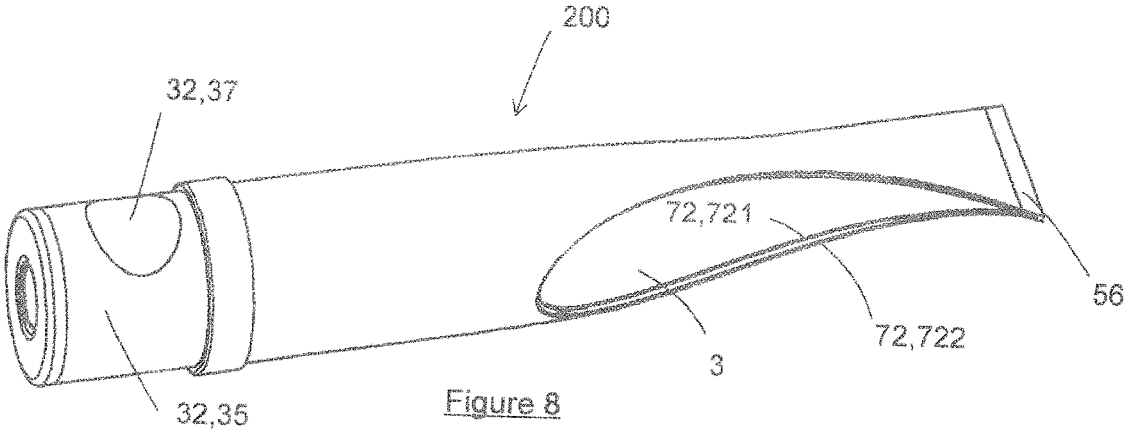
Figure 9:
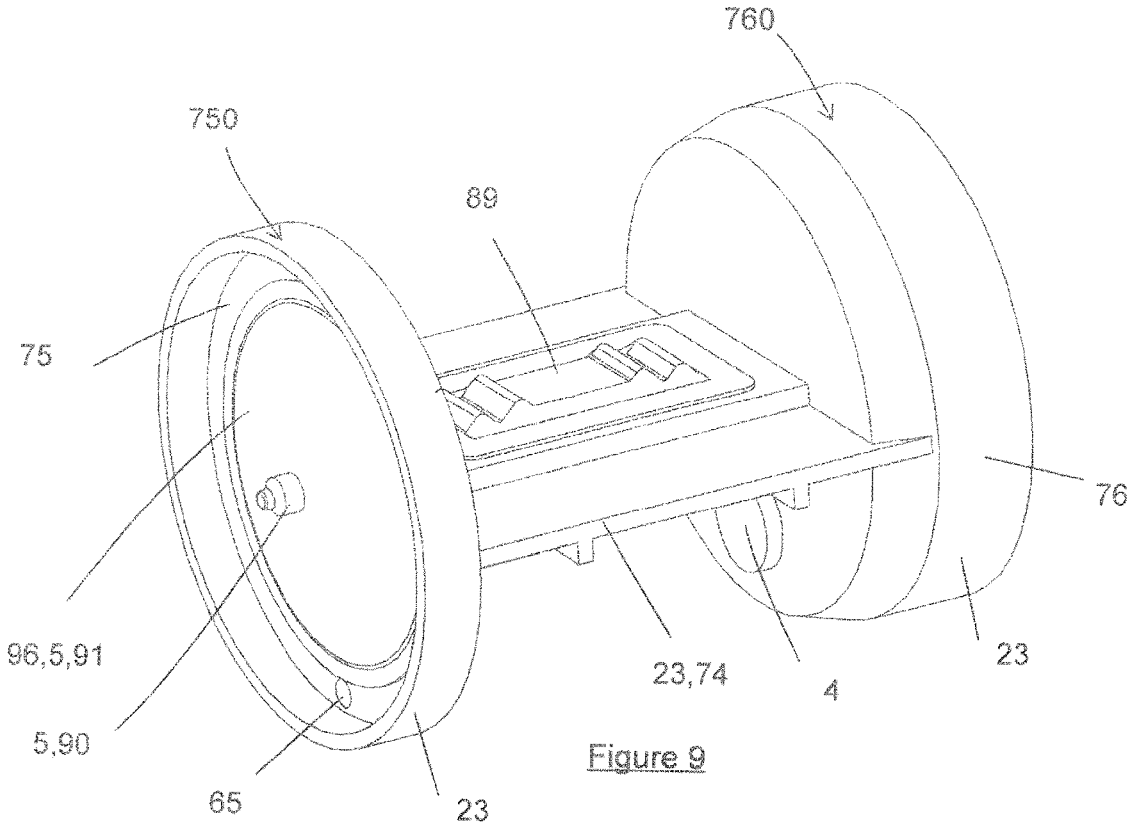
Figure 10:
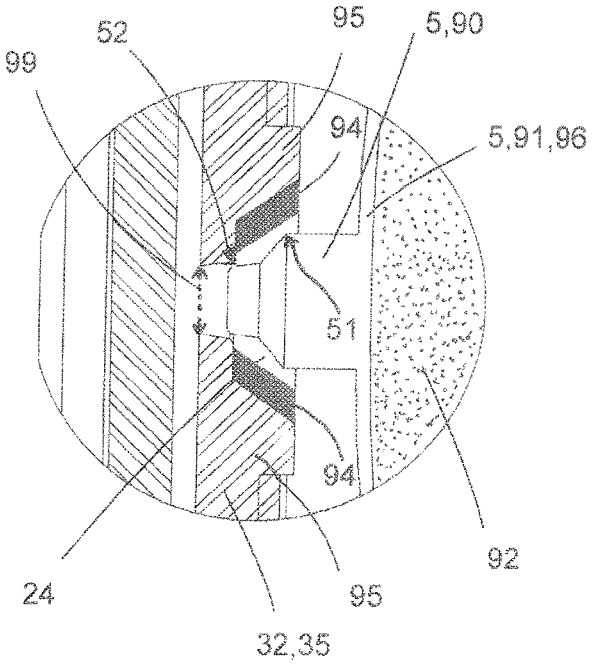
Figure 11:
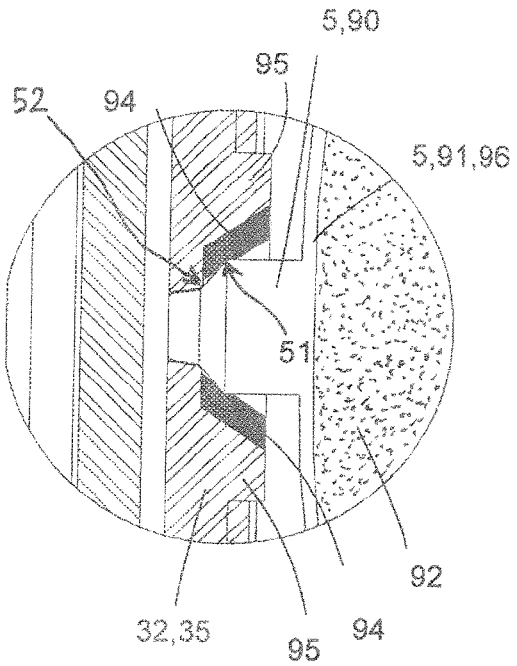
Figure 12:
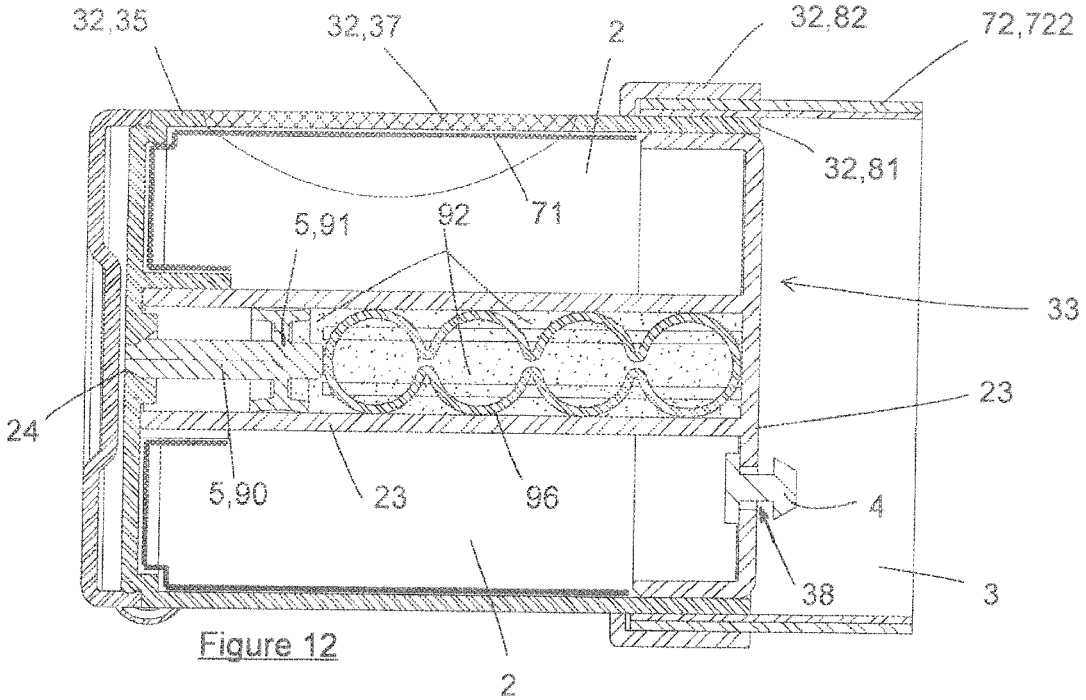
Figure 13:
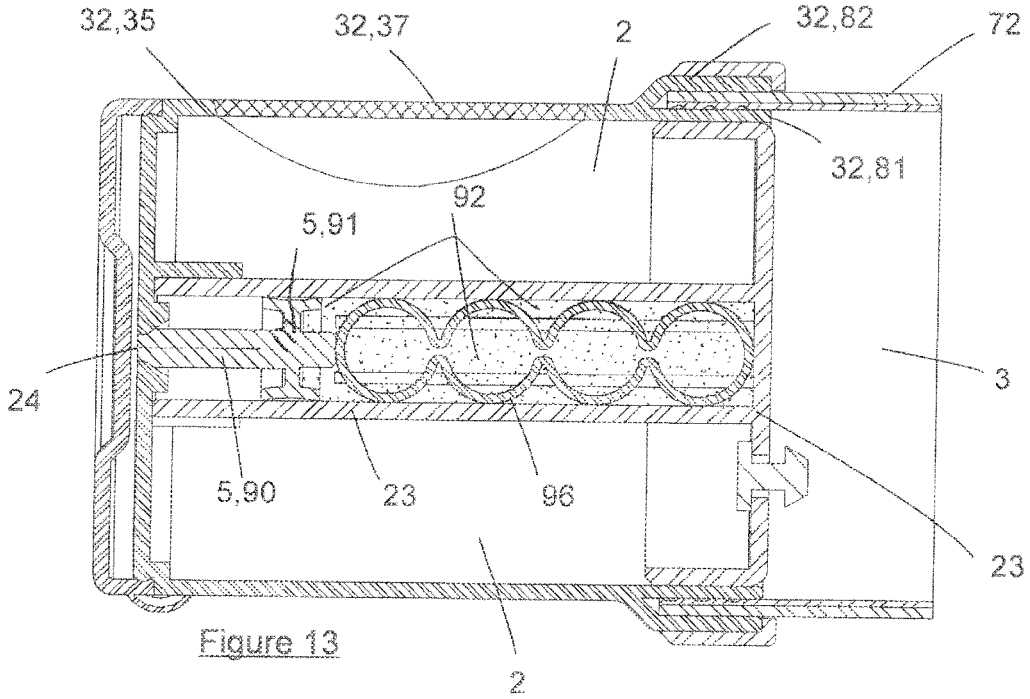
Figure 14:
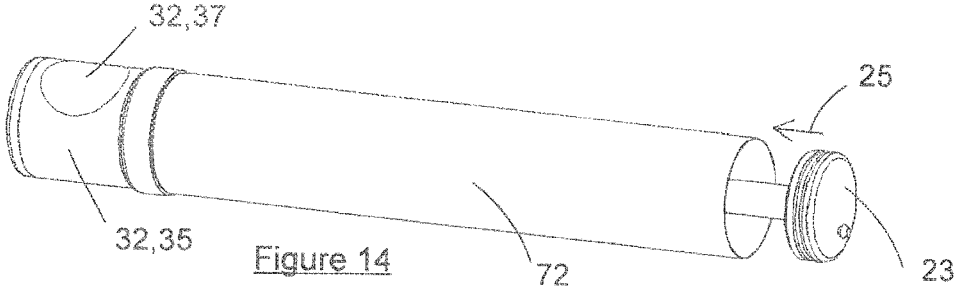
Figure 15:
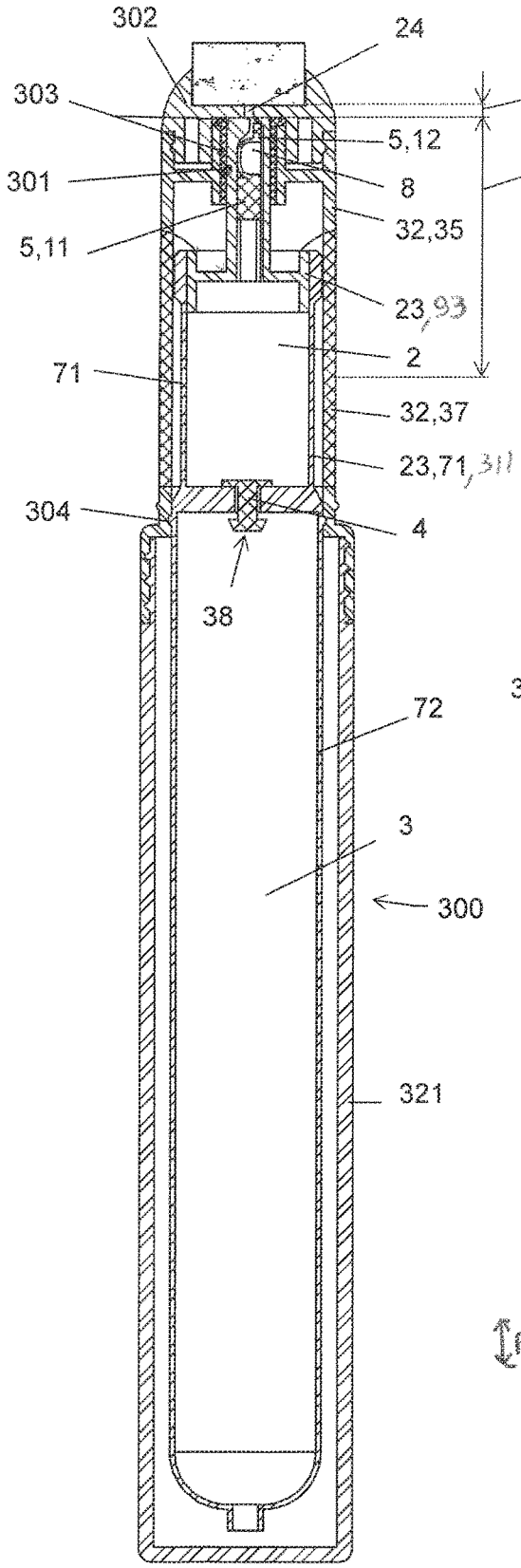
Figure 16:
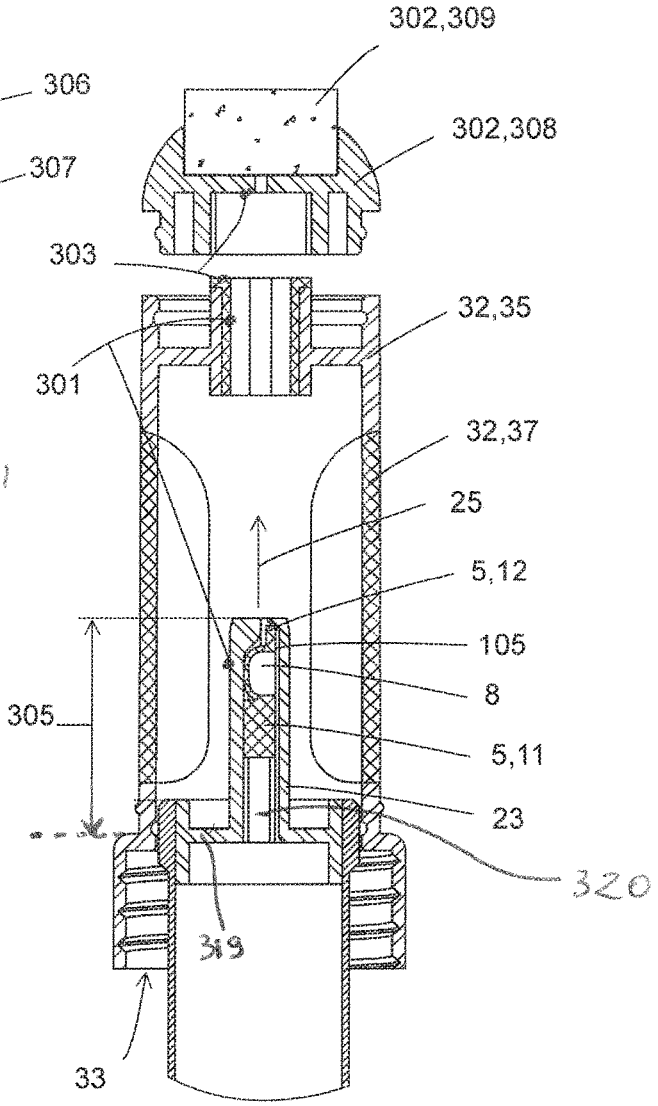
Figure 16A:
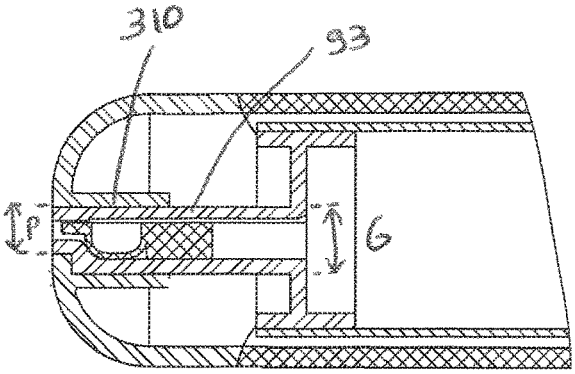
Figure 17:
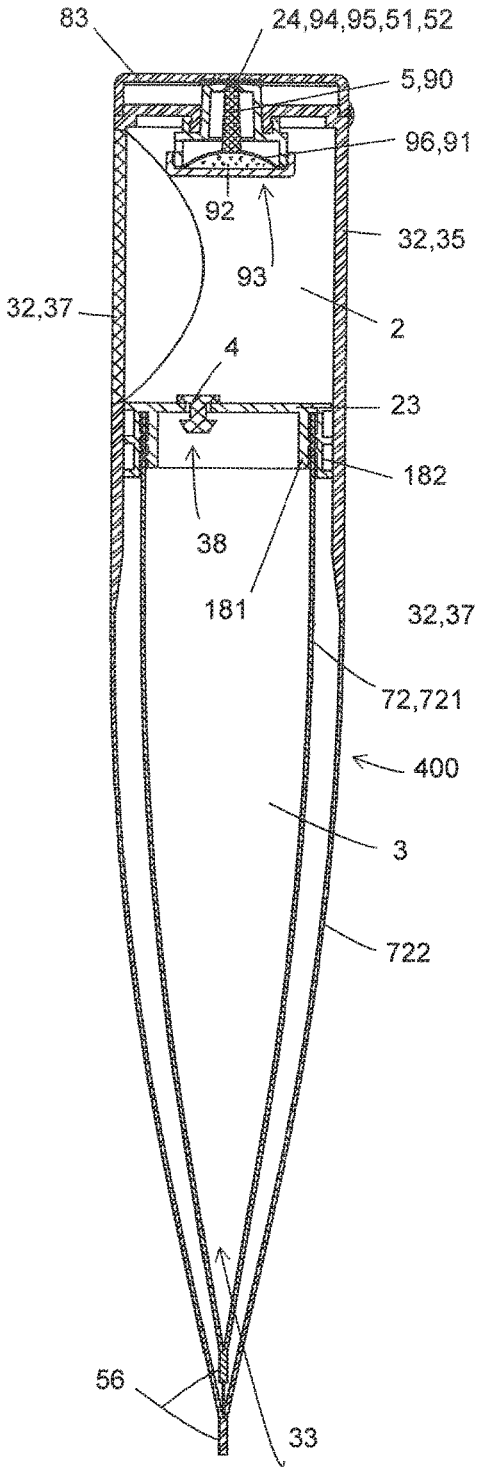
Figure 18:
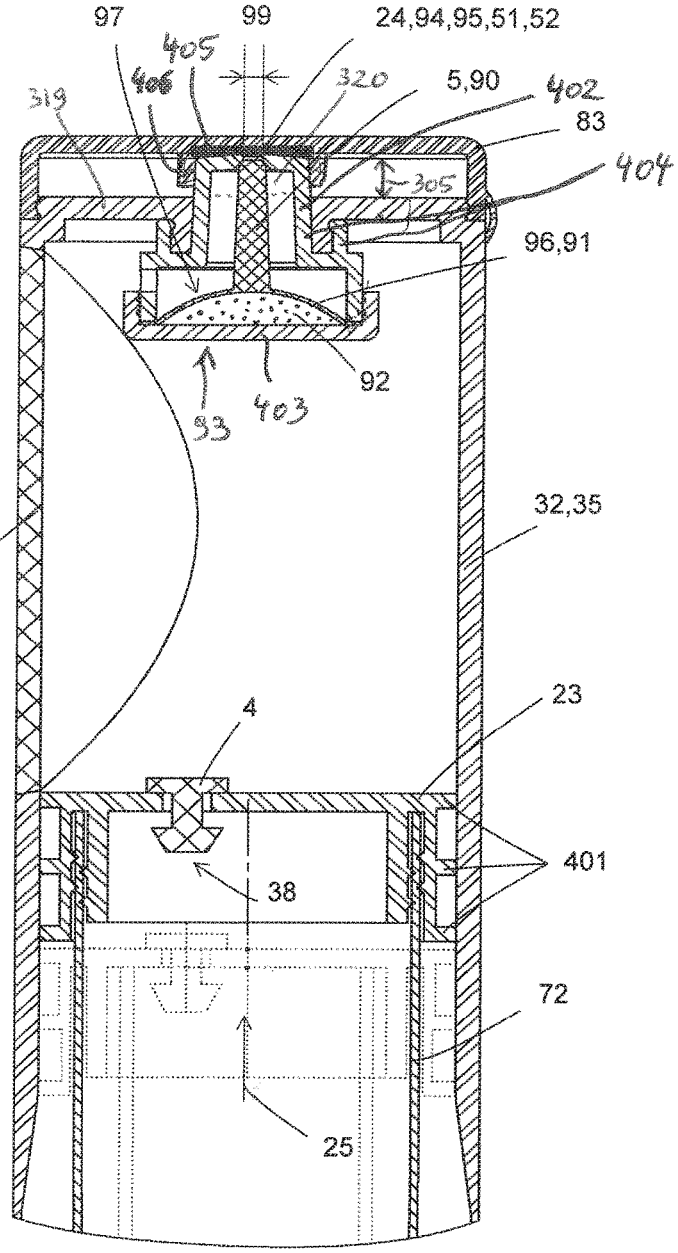
Figure 19:
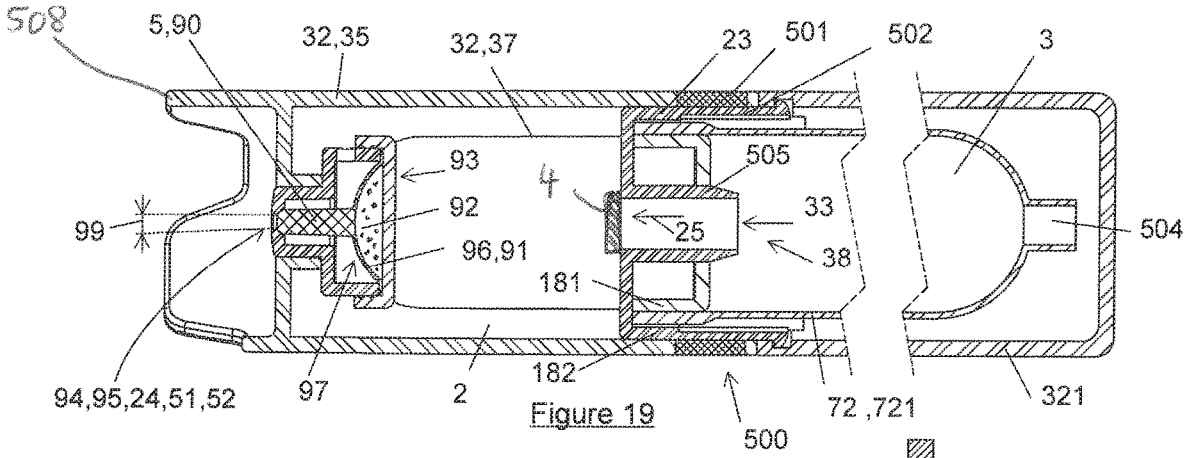
Figure 20:
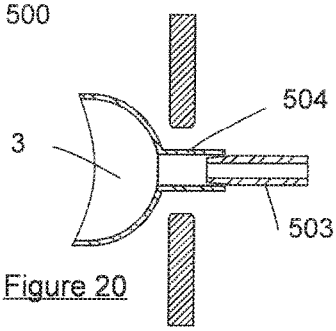
Figure 21:
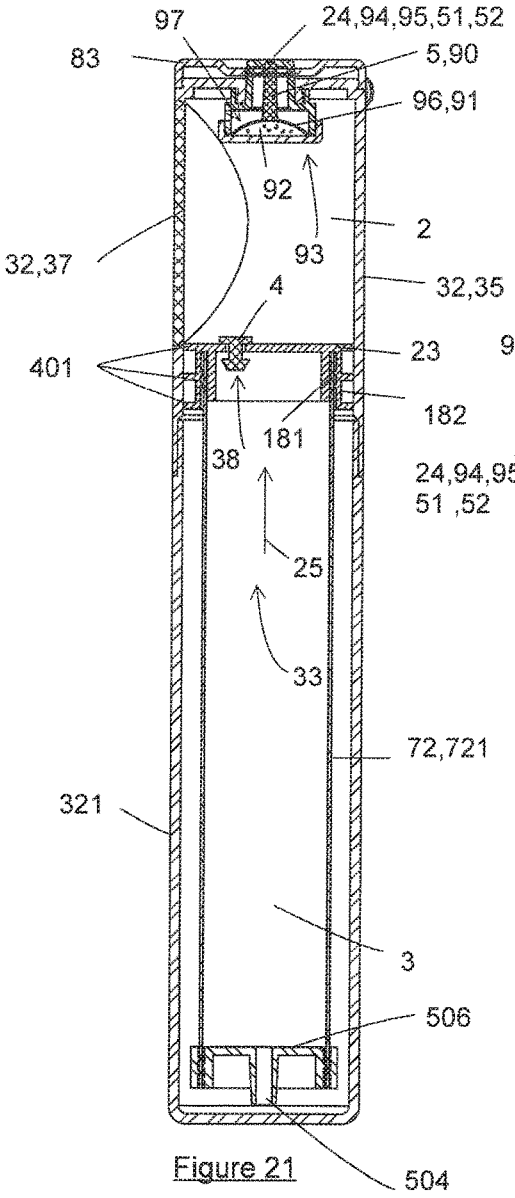
Figure 22:
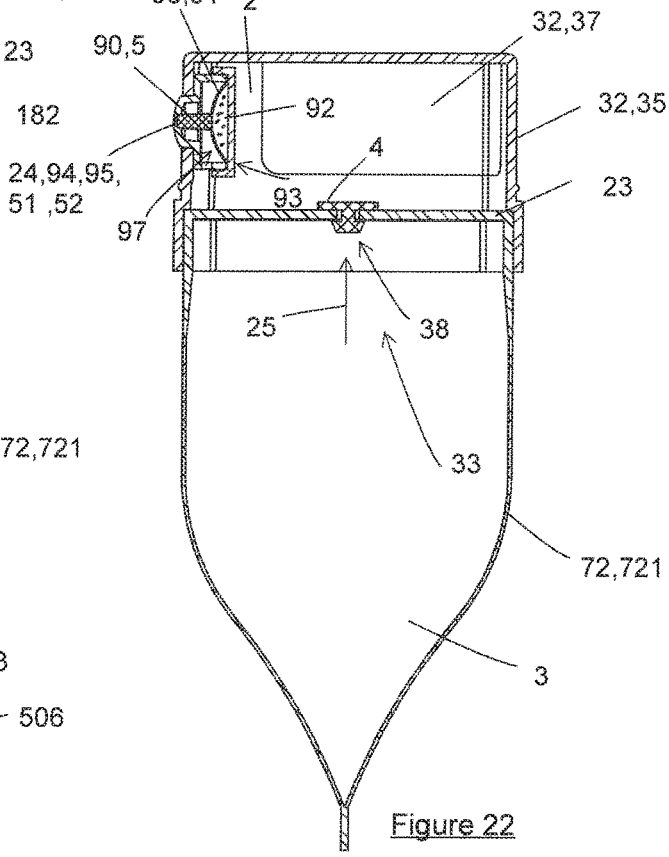

Other advantages and particularities of the invention will appear on reading the detailed description of implementations and non-limiting embodiments, and the following appended drawings:

FIG. 1 is a perspective view of a device of a first embodiment according to the invention, FIG. 2 is a sectional view of part of the device of the first embodiment according to the invention, FIG. 3 is a perspective view of part of the device under assembly of the first embodiment according to the invention, FIG. 4 is a sectional view of part of a variant of the device of the first embodiment according to the invention, FIG. 5 is a sectional view of part of another variant of the device of the first embodiment according to the invention, FIG. 6 is a sectional view of part of a second embodiment according to the invention, FIG. 7 is a perspective view of a return means 73 of the device of the second embodiment according to the invention, FIG. 8 is a perspective view of the device of the second embodiment according to the invention, with part of the reservoir 3 partially in section to show its two walls 721, 722, FIG. 9 is a perspective view of a stopper 23 of the device of the second embodiment according to the invention, FIG. 10 is a sectional view of part of the device of the second embodiment according to the invention, for an open position of the dispensing valve 5, FIG. 11 is a sectional view of part of the device of the second embodiment according to the invention, for a closed position of the dispensing valve 5, FIG. 12 is a sectional view of part of a variant of the device of the second embodiment according to the invention, FIG. 13 is a sectional view of part of another variant of the device of the second embodiment according to the invention, FIG. 14 is a perspective view of the variant of FIG. 12 or 13 of the device of the second embodiment according to the invention, under assembly before insertion of the stopper 23 into the cap 32, FIG. 15 is a sectional view of a third embodiment, FIG. 16 is a partial sectional view of the third embodiment under assembly, FIG. 16*a* is a partial sectional view of a variant of the third embodiment, FIG. 17 is a sectional view of a fourth embodiment, FIG. 18 is a partial sectional view of the fourth embodiment, the stopper 23 being shown twice: once in dotted lines during insertion of the stopper 23 in the cap 32 and once in solid lines after insertion of the stopper 23 into the cap 32, FIG. 19 is a sectional view of a fifth embodiment, FIG. 20 is a partial sectional view of the fifth embodiment, FIG. 21 is a sectional view of a variant of the fifth embodiment, and FIG. 22 is a sectional view of another variant of the fifth embodiment.

As these embodiments are in no way limitative, it is possible in particular to consider variants of the invention comprising only a selection of characteristics described or illustrated below in isolation from the other characteristics described or illustrated (even if this selection is isolated within a sentence comprising these other characteristics), if this selection of characteristics is sufficient to confer a technical advantage or to differentiate the invention with respect to the state of the art; This selection comprises at least one preferably functional characteristic without structural details, and/or with only a part of the structural details if this part alone is sufficient to confer a technical advantage or to differentiate the invention with respect to the state of the art.

Firstly, with reference to FIGS. 1 to 3, a device 100 of a first embodiment according to the invention of fluid dispenser will be described.

The fluid is typically a liquid, a cream, a paste, a gel, a gas or a mixture thereof. The fluid preferably comprises a liquid, a cream, a paste, a gel, or a mixture thereof.

Unless otherwise specified in this specification, all solid parts composing the present device 100 are made of polypropylene (PP). Some parts may be more flexible than others, for example by playing on the thickness of each of these parts.

The device 100 comprises a cap 32 comprising:

an outer wall comprising at least one part called shell part 35 (for example polypropylene (PP)) and at least one part called pressing part 37 (typically a thermoplastic elastomer (TPE) or an octene and ethylene copolymer or in a very thin polypropylene part) made of a softer material than the at least one shell part; this outer wall can be made by bi-injection or overmolding;

an outlet 24, an insertion orifice 33.

The part called pressing part 37 is a deformable wall.

The part called pressing part 37 is a flexible surface.

The device 100 comprises a stopper 23.

The cap 32 and the stopper 23 are arranged in a form that the stopper 23 is mounted in the cap 32, according to an insertion assembly in the cap 32, on the side of the insertion orifice 33 inserted therefrom and along an insertion direction 25.

By stopper 23, not necessarily means a solid element. The stopper 23 may be pierced or pass through fluid. The stopper 23 may for example be an annulus or a ring. By stopper 23, it is meant an element inserted into the cap 32.

The device 100 comprises a deformable chamber 2 whose interior volume is arranged to contain the fluid, the deformable chamber 2 being provided with the outlet 24.

The outlet 24 separates the inside of the chamber 2 and the outside of the device 100.

The device 100 comprises a dispensing valve 5 which, in an open state of the valve 5, allows a passage of fluid from the inside of the chamber 2 towards the outside of the device 100 through the outlet 24 of the chamber 2 and, in a closed state of the valve 5, does not allow it.

The dispensing valve 5 is typically made of polypropylene (PP) or rigid or semi-rigid polyethylene (PE).

The stopper 23 is inserted into the cap 32 from the side of the insertion orifice 33 so that the assembly of the cap 32 and the stopper 23 form the deformable chamber 2, the interior volume is arranged to contain the fluid.

The chamber 2 is provided with an inlet 38 so that the device 100 is arranged to conduct the fluid along a fluid flow path from the inlet 38 and then through the chamber 2 and up to the outlet 24.

The inlet 38 is provided with a feed valve 4 (typically thermoplastic elastomer (TPE) or an octene and ethylene copolymer of 75 Shore A).

When open, the feed valve 4 allows a passage of fluid, from a reservoir 3 and upto into the chamber 2. When closed, the feed valve 4 does not allow such a passage of the fluid.

The feed valve 4 is arranged to open during an increase of the internal volume of the chamber 2 filled with fluid to be dispensed or during a depression in the chamber 2 relative to a state of equilibrium of the chamber.

The feed valve 4 is arranged to close during a decrease of the internal volume of the chamber 2 or during an overpressure in the chamber 2 relative to the state of equilibrium of the chamber.

In the state of equilibrium of the chamber 2, the valve 4 is preferably closed.

The inlet 38 passes through the stopper 23.

The part called pressing part 37 is arranged to be movable so as to modify the internal volume of the chamber 2.

The dispensing valve 5 comprises a pin 90 (or a rod 90) integral with a movable member of the valve 5.

The pin 90 is:

partially (in particular not the end of the pin 90) comprised within the deformable chamber 2 in the closed position of the dispensing valve 5, and/or entirely comprised within the deformable chamber 2 in the open position of the dispensing valve 5.

The movable member of the valve 5 is entirely comprised within the deformable chamber 2.

The dispensing valve 5 is:

partially (in particular not the end of the pin 90) comprised within the deformable chamber 2 in the closed position of the dispensing valve 5, and/or entirely comprised within the deformable chamber 2 in the open position of the dispensing valve 5.

The pin 90 has one end which:

in the closed state of the dispensing valve 5, closes the outlet 24 of the chamber 2 and in the open state of the dispensing valve 5, is spaced from the outlet 24 of the chamber 2 compared to the closed state of the dispensing valve 5.

The movable member of the valve 5 is arranged to move under the effect of an overpressure of the fluid, in the interior volume of the chamber 2, greater than a pressure threshold (depending in particular on the total stiffness of the return means 96) relative to the equilibrium state of the chamber 2, so as to move the pin 90 away from the outlet 24 of the chamber 2 so as to move the dispensing valve 5 from its closed state to its open state. Such an overpressure can be caused by a decrease in the internal volume of the chamber 2 filled with fluid to be dispensed, for example when a user presses on the flexible pressing surface 37.

The movable member of the valve 5 is further arranged, in other cases, to hold the valve 5 closed or move so as to move the pin 90 towards the outlet 24 of the chamber 2 so as to move the dispensing valve 5 from its open state to its closed state.

The movable member of the valve 5 comprises at least one movable wall 91 of at least one gas pocket 92.

Each movable wall 91 is entirely comprised within the deformable chamber 2.

Three gas pockets 92 are shown in FIG. 2.

Each gas pocket 92 contains a gas (typically air) without being able to exit this pocket 92. Each gas pocket 92 is arranged to isolate this gas (represented by small dots in the figures) relative to the fluid contained in the deformable chamber 2.

Each gas pocket 92 is completely surrounded (along a closed loop surrounding this pocket 92 at 360° around this pocket 92) by the fluid contained in the chamber 2.

Each gas pocket 92 is arranged so that:

the displacement of the movable member of the valve 5 of this pocket 92 and/or the displacement of the pin 90 away from the outlet 24 of the chamber 2 and/or the displacement of the dispensing valve 5 from its closed state to its open state causes a compression of the gas in the pocket 92;

the displacement of the movable member of the valve 5 of this pocket 92 and/or the displacement of the pin 90 in the direction of the outlet 24 of the chamber 2 and/or the displacement of the dispensing valve 5 from its open state to its closed state causes an expansion of the gas in the pocket 92.

The movable wall 91 of each gas pocket 92 has a contact surface 97 arranged to be in full contact with the fluid contained in the chamber 2.

This contact surface 97 of each pocket 92 is defined as being the surface of the wall 91 (typically of thickness less than 1 mm or preferably less than 500 μm) which is of a first side arranged to be in contact with the fluid contained in the chamber 2 and another side opposite to the first in contact with the gas of this pocket 92; the surface of the pin 90 is therefore not counted.

The sum of the areas of the contact surfaces 97 of the gas pocket(s) 92 is at least thirty-five times (and even at least forty-five times) greater than a minimum area 99 of fluid passage through the outlet 24 of the chamber 2. This minimum area 99 is the smallest area of passage plane of the fluid through the outlet 24 to the outside of the chamber 2 and the device 100.

The sum of the areas of the contact surfaces 97 of the gas pocket(s) 92 is at least 50 $mm^2$ and even greater than 70 $mm^2$ and even greater than 90 $mm^2$.

Each contact surface 97 is convex on the side of the fluid contained in the deformable chamber 2.

The device 100 comprises several movable walls 91 of several gas pockets 92 aligned along an axis of elongation of the pin 90, this axis of elongation being also an axis of displacement of the pin 90 between the open position and the closed position of the valve 5.

The pressure inside each gas pocket 92 is typically:

- greater than one atmosphere and/or
- in the range between 0.9 and 1.5 atmospheres, preferably in the range between 0.9 and 1.1 atmospheres, preferably equal to one atmosphere The dispensing valve 5 and the at least one gas pocket 92 are part of a module 93 inserted in the device 100 from outside the device 100. The module 93 is welded, preferably ultrasonically, to the rest of the device 100, more exactly to the cap 32.

The pin 90 and/or the movable member of the valve 5 are arranged to be in contact with the fluid contained in the deformable chamber 2.

The pin 90 is arranged only to be partially in contact with the fluid contained in the chamber 2: in fact, in the closed position of the valve 5, the end of the pin 90 is hidden from the inside of the chamber 2 by the outlet 24.

The movable member of the valve 5 is arranged only to be partially in contact with the fluid contained in the chamber 2: in fact, each movable wall 91 has one of its sides in contact with the gas in its pocket 92.

The device 100 comprises at least one return means 96 arranged to exert on the pin 90 a return force so as to push the pin 90 towards the outlet 24 of the chamber 2 so as to bring back the dispensing valve 5 from its open position to its closed position.

In this embodiment, the at least one return means 96 comprises each movable wall 91 (convex and flexible) of gas pocket 92.

Each movable wall 91 is arranged to deform during its movement.

In this embodiment, the return means 96 (here the movable walls 91) of the different pockets 92 accumulate their effects and add their stiffnesses for a greater return force or closing force.

Each wall 91 forms a dome.

Each gas pocket 92 allows to facilitate, for a user, the passage of the valve 5 from its closed state to its open state, while ensuring a good closure of the valve 5 in its closed state.

The interior volume of the deformable chamber 2 is delimited at least in part by the cap 32.

The internal volume of the deformable chamber 2 is delimited at least in part by the stopper 23.

The dispensing seat is formed by all the points of contact, on the cap 32 and/or the module 93, between the dispensing valve 5 and the cap 32 and/or the module 93 when the valve 5 is in its closed state. Note that, during the deformation of the deformable chamber 2, the dispensing seat is stationary.

Note that there is no valve in the fluid flow path between the inlet 38 (and/or the valve 4) and the dispensing valve 5.

Note that there is no mechanical connection between the wall 37 and the at least one pocket 92, the only connection between the wall 37 and the at least one pocket 92 is via the fluid to be dispensed.

With reference to FIG. 4, a first variant of the first embodiment of the device 100 according to the invention will now be described, only for its differences with respect to the first embodiment previously described with reference to FIGS. 1 to 4.

In this variant, each movable wall 91 is rigid. Each movable wall 91 is arranged not to deform during its movement.

Each wall 91 forms a piston.

Each movable wall 91 is not part of the at least one return means 96.

The at least one return means 96 comprises, for each gas pocket 92, a spring inside this gas pocket 92 and in contact with the movable wall 91 of this gas pocket 92.

With reference to FIG. 5, a second variant of the first embodiment of the device 100 according to the invention will now be described, solely for its differences with respect to this first embodiment previously described with reference to FIGS. 1 to 4.

This second variant comprises a gas pocket 92.

The area of the contact surface 97 of the gas pocket 92 is at least thirty-five times (and even at least forty-five times) greater than the minimum area 99 of fluid passage through the outlet 24 of the chamber 2.

The area of the contact surface 97 is at least 50 $mm^2$ and even greater than 70 $mm^2$ and even greater than 90 $mm^2$.

The at least one return means 96 comprises, for each pocket 92:

- a part (thin and flexible) of the movable wall 91 of this pocket 92, and
- a spring inside this gas pocket 92 and in contact with the movable wall 91 of this gas pocket 92.

It is further noted in this variant that the movable wall 91 is movably mounted substantially perpendicularly to the axis of displacement or elongation of the pin 90, preferably by means of a slope 98 by sliding between the pin 90 and the wall 91. The device 100 is arranged to return, a translational movement of the wall 91 different from the axis of elongation of the pin 90, into a translation movement of the axis of elongation of the pin 90 during the opening/closing phases of the valve 5.

In this variant, there is a loss due to friction or sliding, but the area of the contact surface 97 is very large and greater than 150 $mm^2$.

Finally, in this variant, the at least one gas pocket 92 is not part of the module 93.

With reference to FIGS. 6 to 11, a device 200 of a second embodiment according to the invention will now be described, only for its differences with respect to the device 100 of the first embodiment of FIGS. 1 to 3. Common reference numerals therefore will not be introduced again.

With reference to FIGS. 10 and 11, in the device 200 of this second embodiment, the outlet 24 is delimited by a periphery comprising:

- a part called flexible part 94 (for example made of thermoplastic copolyester (TPEE)), and
- a part called rigid part 95 (for example of polybutylene terephthalate (PBT)) in a material that is more rigid or hard than the flexible part 94 (the two hardnesses compared being measured in the same unit among Shore A or Shore D), the rigid part 95 being closer to the outside of the deformable chamber 2 than the flexible part 94.

The pin 90 is more rigid or hard than the flexible part and the rigid part (the hardnesses compared being measured in the same unit among Shore A or Shore D).

For the pin 90:

the hardness of pin is greater than 30 Shore D, or even greater than 70 Shore D, and/or the pin 90 has a flexural modulus greater than 200 MPa, or even greater than 500 MPa.

The pin 90 is flush (as shown) or protrudes less than 1 mm from the outlet 24.

The end of the pin 90 is less than 1 mm from the outlet 24 (forward or backward of the outlet 24).

In a variant, the pair TPEE and PBT can be replaced by a pair of polypropylene (PP) and copolymer of octene and ethylene, respectively.

In the closed position of the dispensing valve 5 shown in FIG. 11, the end of the pin 90 is in contact with the flexible part 94 in a first contact line, preferably along a stop 51 of the pin 90. This first contact line is a closed line of contact going around the pin 90.

The stop 51, in a cross sectional view of the pin 90, forms an angle less than 150° on the side of the pin 90.

In the closed position of the dispensing valve 5 shown in FIG. 11, the end of the pin 90 is also in contact with the rigid part 95 in a second contact line, preferably along a stop 52 of the cap 32. This second contact line is a closed line of contact going around the pin 90.

The stop 52, in a cross sectional view of the cap 32, forms an angle less than 150° on the side of the cap 32.

The pin 90 is arranged so that, during a passage of the valve 5 from its open position to its closed position, the first line of contact is formed before the second line of contact.

The maximum distance between the first line of contact and the outside of the chamber 2 on the side of the outlet 24 is less than 6 mm or even 4 mm.

The maximum distance between the second of contact and the outside of the chamber 2 on the side of the outlet 24 is less than 6 mm or even 4 mm.

Referring to FIG. 6, it is noted that a gas pocket 92 is partially delimited by its movable wall 91 integral with the pin 90 but is further delimited by a compensation wall 89 which is also movable and which is in contact with:

on its first face, gas contained in the pocket 92, and on its second face opposite to its first face, fluid contained in the chamber 2.

Unlike the wall 91, the compensation wall 89 is arranged so that a displacement of the wall 89 inside the chamber 2 does not cause movement of the pin 90 and therefore of the valve 5.

The compensation wall 89 makes it possible to absorb variations experienced by the fluid in the chamber 2 (for example temperature variation) without such variations opening the valve 5.

The wall 89 is thinner and/or more flexible or less hard than each wall 91 (the two hardnesses compared being measured in the same unit among Shore A or Shore D).

In addition, FIG. 6 shows an outer cap 83 pressed against the outlet 24.

The device 200 further comprises a chamber film 71 delimiting at least part of the internal volume of the deformable chamber 2 and arranged to be in contact with the pressing part 37 of the cap 32.

The chamber film 71 is in contact with the pressing part 37 at least when a user presses on this pressing part 37 to reduce the internal volume of the chamber 2.

The chamber film 71 is:

either a film of initially liquid material typically deposited by a spray or by evaporation (for example a deposit of a polyurethane layer (PU) by spray and then a deposit of a silicone layer by spray). Such a film has a thin thickness typically less than 150 μm, or a film of material (for example a central layer of aluminum or a copolymer of ethylene and of vinyl alcohol (EVOH), this central layer being surrounded by two layers of polyethylene (PE)) assembled with the solid state with the other parts composing the device according to the invention 200; Such a film has a thicker thickness typically greater than 100 μm or 200 μm.

The chamber film 71 is positioned between the fluid contained in the deformable chamber 2 and the cap 32 so that at least a part of the cap 32 (preferably at least the pressing part 37) is not in contact with the fluid contained in the chamber 2.

The film 71 is in two parts: a part surrounding the stopper 23 and a part disposed at the bottom of the cap 32, that is to say opposite to the insertion orifice 33.

The chamber film 71 is positioned between the fluid contained in the deformable chamber 2 and the cap 32 so that the cap 32 does not come into contact with the fluid contained in the chamber 2.

The chamber film 71 is positioned between the fluid contained in the deformable chamber 2 and the cap 32 so that any junction between the cap 32 and the stopper 23 does not come into contact with the fluid contained in the chamber 2.

The device 200 further comprises (especially in the case of a film 71 assembled in the solid state), inside the chamber 2, a return means 73 arranged to exert on the chamber film 71 a return force pushing the chamber film 71 against the pressing surface 37.

The stopper 23 comprises an elongate member 74 provided with two ends 75, 76, each of these ends having a periphery 750, 760 in contact with the chamber film 71 so that, for each periphery respectively 750, 760, the chamber film 71 is located between this periphery respectively 750, 760 and the cap 32.

In addition, the chamber film 71 forms a seal preventing passage of the fluid between the stopper 23 and the cap 32 at each periphery 750, 760.

The end 75 comprises at least one orifice 65 allowing a passage of the fluid through the end 75.

Each periphery 750, 760 forms a closed loop 360° around the elongated member 74.

The chamber film 71 is welded to the stopper 23, more exactly to the end 75 or the periphery 750 located at the deepest of the cap 32 with respect to the orifice 33; especially in the case of a film 71 assembled in the solid state.

The chamber film 71 is held, preferably by clamping, between the cap 32 and the stopper 23; especially in the case of a film 71 assembled in the solid state. More exactly, the chamber film 71 is maintained, preferably by clamping, between the cap 32 and the end 76 or the periphery 760 located at the minimum depth of the cap 32 with respect to the orifice 33.

The device 200 further comprises at least one reservoir film 72, extending outwardly of the cap 32 so as to form the fluid reservoir 3 in communication with the deformable chamber 2 via the inlet 38.

The at least one reservoir film 72 is held in the device 200 at least in part by a force exerted by the stopper 23 on the cap 32.

The device 200 shown in FIG. 6 comprises two reservoir films 721, 722.

The end, opposite to the cap 32 and/or stopper 23, of the reservoir 3 or tube formed by each film 72, is welded along a weld line 56 which is preferably common to all the films 72 (721, 722).

Advantageously, the device 200 naturally comprises a layer of gas (preferably air) between the two films 721 and 722 which avoids a delamination process.

Films 721 and 722 are two tubes nested one inside the other.

The first reservoir film 72, 721 is clamped between the cap 32 and the stopper 23, more exactly between the cap 32 and the end 76 or the periphery 760 located at the minimum depth of the cap 32 with respect to the orifice 33.

The second reservoir film 72, 722 is held between two walls 81, 82 of the cap 32, these two walls 81, 82 being arranged to come closer to pinch the reservoir film 72, 722 after insertion of the stopper 23 into the cap 32 under the action of the force exerted by the stopper 23 on the cap 32.

The two walls 81, 82 are concentric and each form a closed loop.

The second 82 of these walls is an outer ring.

In this case the cap 32 comprises two parts: one part comprising the wall 81 and one part comprising the ring 82. The ring 82 is an insert.

The first 81 of these walls is a wall of the cap 32 located inside the outer ring 82.

There is a discontinuity of material between the wall 81 and the ring 82.

Note that the reservoir film 721 and the chamber film 71 are the same film.

The film 722 is made of polyethylene (PE).

The reservoir film 721 and/or 722 may be made from a rolled film rolled on itself or an extruded or coextruded tube.

The film 722 comprises at least one hole 55 concealed under the wall 82 allowing gas or air to enter and exit the space between the two films 721 722, for example during shrinkage or expansion of the film 721 during a temperature change.

The two films 721, 722 are concentric except at the position of the weld 56, that is to say that, except at the position of the weld 56, each of these films 721, 722 forms a closed wall surrounding the same axis (common to these two films 721, 722) located inside the reservoir 3.

Both films 721 and 722 are located on either side of the cap 32.

More specifically, the two films 721 and 722 are located on either side of the wall 81 of the cap 32.

It will be noted that the chamber film 71 makes it possible to improve the retention of the fluid of the chamber 2 and avoids a chemical attack by the fluid, in particular on the walls of the cap 32 and the junctions between the cap 32 and the stopper 23.

The chamber film 71 also makes it possible to form a barrier to light and/or air outside the device 200, to avoid the evaporation of the fluid contained in the chamber 2, and to avoid denaturing the composition of the fluid contained in the chamber 2.

It will be noted that the reservoir film 72 makes it possible to simplify the manufacturing process of the device 200 according to the invention and/or to reduce the number of parts composing the device 200 according to the invention.

The internal volume of the deformable chamber 2 is delimited at least in part by the film 71 disposed between the surface 37 and the chamber 2.

The internal volume of the deformable chamber 2 is delimited at least in part by the stopper 23.

With reference to FIGS. 12 and 14, a first variant of the second embodiment of the device 200 according to the invention will now be described, only for its differences with respect to the second embodiment previously described with reference to FIGS. 6 to 11.

In this variant, contrary to the case of FIGS. 6 to 11, the movable wall 91 is not convex and does not form a dome, but forms a piston.

The at least one return means 96 does not include the movable wall 91 but includes, for each gas pocket 92, a spring inside this gas pocket 92 and in contact with the movable wall 91 of this gas pocket 92.

This variant does not include the reservoir film 721.

Note that the reservoir film 722 is a multilayer film, comprising for example:

- an internal thickness (on the side of the fluid contained in the reservoir 3) made of polyethylene (PE) or of ethylene-vinyl acetate (EVA), and
- an external thickness comprising a central layer of aluminum or a copolymer of ethylene and of vinyl alcohol (EVOH), this central layer being surrounded by two layers of polyethylene (PE).

These two thicknesses can delaminate.

With reference to FIGS. 13 and 14, a second variant of the device 200 of the second embodiment according to the invention will now be described, solely for its differences with respect to the first variant of the second embodiment previously described with reference to FIGS. FIGS. 12 to 14.

In this second variant, the wall 82 is not a ring. There is no discontinuity of material between the walls 81 and 82.

Firstly, with reference to FIGS. 15 and 16, a device 300 of a third embodiment according to the invention of fluid dispenser will be described.

This embodiment 300 will only be described for its differences with respect to the second mode 200 of FIGS. 6 to 11.

In this device 300 the internal volume of the deformable chamber 2:

- is not delimited at least in part by the cap 32
- is delimited at least in part by the stopper 23, preferably only by the stopper 23 (whose wall 71 which, in this embodiment, is integrated in the stopper 23).

The device 300 does not include the compensation wall 89 (but may include it in a variant).

The valve 5 does not include pin 90 or return means 96. The valve 5 is located in a dispensing housing 8.

The valve 5:

- in an open state, allows a passage of fluid from the interior of the chamber 2 to the outlet 24 through the dispensing housing 8, and
- in a closed state, does not allow a passage of fluid from the interior of the chamber 2 to the outlet 24 through the housing 8.

The valve 5 is clamped in the housing 8.

The dispensing valve 5 comprises a part 11 held (preferably by clamping or clipping) between the inner walls of the housing 8.

The part 11 is stationary between the open and closed states of the dispensing valve 5.

The dispensing valve 5 comprises a movable part 12 which, in the closed state of this dispensing valve 5, is pressed against a dispensing seat 105 so as to block up the dispensing seat 105, and in the open state of this dispensing valve 5, deviates from the dispensing seat 105 so as to open the dispensing seat 105.

This part 12 is a membrane or lamella.

The part 12 is movable between the open and closed states of the dispensing valve 5.

Note further that the dispensing seat 105 is a lateral part of the inner walls of the housing 8, that is to say this seat 105 is limited to one face, preferably flat (or curved), of the internal walls of the housing 8, and does not do all the round a section of the housing 8 which would be made in a plane perpendicular to the direction of elongation of the part of the housing 8 containing the valve 5.

The chamber film 71, defining at least partly the interior volume of the deformable chamber 2 and arranged to be in contact with the pressing part 37 of the cap 32 (at least when a user presses on this pressing part 37 to reduce the internal volume of the chamber 2), is secured to the part of the stopper 23 carrying the inlet 38.

The film 71 is in the same material as the part of the stopper 23 carrying the inlet 38.

The film 71 and the part of the stopper 23 carrying the inlet 38 form a single part without material discontinuity.

The film 71 can be made by injection.

The flexibility of the film 71 is obtained by a thinner thickness than the part of the stopper 23 carrying the inlet 38.

The device 300 does not include the return means 73 (although it could be present in a variant).

Thus the stopper 23 comprises two parts:

- a rear part 311 comprising the film 71 and the part of the stopper 23 carrying the inlet 38, and
- a front part or module 93 in which the housing 8 is formed and which is mounted in insertion in the part comprising the film 71 and the part of the stopper 23 carrying the inlet 38, through an orifice situated at one end of the chamber 2 opposite to the part of the stopper 23 carrying the inlet 38. In a variant (not shown), this front part can be replaced by a module 93 with pocket 92 and pin 90 as previously described.

The film 71 (mostly 0.3 mm thickness) comprises a circumferential extra thickness (approximately 0.8 mm total thickness) within which the front part 93 is accommodated.

The front part or module 93 comprises a projecting part 305 with respect to the chamber 2 and toward the outlet 24.

This part 305 extends over a length of at least 3 mm.

This part 305 comprises at least a part of the dispensing valve 5 which separates the closure of the valve (dispensing seat) forwardly, and this allows:

- to reduce the dead zones of liquid after the valve 5 (unprotected)
- that the pressing zone is not too close to the outlet 24 (more comfortable to use)
- to fix or catch an applicator (not shown).

This projecting part 305 extends over at least 3 or even at least 5 or even at least 10 mm in length.

In a variant, these two front and rear parts are combined into a single part without discontinuity of material.

The reservoir film 72 is integral with the part of the stopper 23 carrying the inlet 38.

The film 72 is in the same material as the part of the stopper 23 carrying the inlet 38.

The film 72 and the part of the stopper 23 carrying the inlet 38 form a single part without discontinuity of material.

The flexibility of the film 72 is obtained by a thinner thickness than the part of the stopper 23 carrying the inlet 38.

Thus the stopper 23 comprises two parts:

- a rear part 311 comprising the film 71, the film 72 and the part of the stopper 23 carrying the inlet 38, and
- a front part or module 93 in which the housing 8 is formed and which is mounted in insertion in the part comprising the film 71 and the part of the stopper 23 carrying the inlet 38, through an orifice situated at one end of the chamber 2 opposite the part of the stopper 23 carrying the inlet 38.

In a variant, these two front and rear parts are combined into a single part without discontinuity of material.

This stopper thus forms an exchangeable refill of the device 300. This refill incorporates the chamber 2. This chamber 2 is made at least in part by the thin cylindrical wall 71.

This stopper 23 is completely enclosed inside a case comprising:

- the cap 32
- a base 321 attached to the cap 32 (for example screwed or clipped to the cap 32)

In a variant, the stopper 23 may comprise a part (in point) towards the reservoir 3 to prevent pinching of the reservoir 3 during its retraction (not shown).

The cap 32 is equipped, on the outside of the cap 32, with an accessory 302 (for example clipped or screwed onto the cap 32) having an orifice which communicates with the outlet 24.

The refill 23, 5, 8, 71, 72 (more precisely the front part in which the housing 8 is formed) has a sealing zone 301 with the cap 32 so that the outgoing product does not go into the cap 32, for example does not go into between the cap 32 and the wall 71 of the deformable chamber.

Similarly, it has a sealing zone 303 between the accessory 302 and the cap 32.

The refill 23, 5, 8, 71, 72 is maintained in the cap 32 by a lateral interlock 304 and the slight tightening in the sealing zone 301.

The accessory or applicator 302 may comprise:

- a tip 308 plus a foam member 309 (as shown in FIGS. 15 and 16), and/or
- a brush, and/or
- a ball, and/or
- a massaging element, and/or
- etc.

The projecting zone 305 emerges from the stopper 23 over a length of at least 3 mm or even at least 8 mm.

The dead zone 306 in the orifice of the accessory 302 communicating with the outlet 24 before the applicator element 309 is less than 15 mm and even preferably less than 10 mm, ideally less than 5 mm in length.

The distance 307 between the closing of the valve 5 and the center of the pressing zone 37 is more than 20 mm.

The valve 5 enters the accessory 302.

The button 37 can be:

- flexible as shown or
- in a rigid variant, it can be slidable or articulated so as to form a lever arm.

With reference to FIG. 16*a*, the accessory 302 can be directly integrated into the cap 32.

The module 93 (comprising the valve 5) is inserted into a spout 310 oriented towards the inside of the cap 32.

The interface between the module 93 and the spout 310 is sealed to the product to be dispensed.

This spout 310 is part of the cap 32.

With reference to FIG. 16, the chamber 2 (more exactly the module 93) comprises a chamber channel 320 which starts at the intersection of the end face 319 of the wall of the chamber 2 and the projecting part 305.

The dispensing seat is in the chamber channel 320 or at most 1 mm after the chamber channel 320.

Referring to FIG. 16*a*, there is in the spout 310 two openings: one smaller (P) than the other and one larger (G) than the other. In the small is fitted a pin of the valve 5 at the end of the protruding part 12 preferably cylindrical. The tightness of this interlocking (round) is sufficient. This projecting part is off-center. The device 300 comprises indexing means for orienting the cartridge or refill within the device 300.

With reference to FIGS. 17 and 18, a device 400 of a fourth embodiment according to the invention of fluid dispenser will now be described.

This embodiment 400 will only be described for its differences with respect to the second mode 200 of FIGS. 6 to 11.

The dispensing valve 5 and the at least one gas pocket 92 are part of a module 93 inserted in the device 400 from inside the device 400 (more exactly from inside the cap 32, more exactly from inside the chamber 2). The module 93 is welded, preferably ultrasonically, to the rest of the device 400, more exactly to the cap 32.

The module 93 comprises a tank 402 comprising two diameters:

- a part of smaller diameter for receiving the pin 90, and passing through the cap 32
- a part of larger diameter for receiving the wall 91, and directly welded to the wall 91.

It is the same part, ie tank 92 without intermediate, which is firstly directly attached to the wall 91 and secondly forms the dispensing seat.

The module 93 comprises a cover 403 fixed (typically welded or fitted) to the tank 402 and delimiting the inside of the pocket 92 with the wall 91.

The module 93 (more exactly the tank 402) comprises a double wall 404 and is fixed to the rest of the device 400, preferably to the cap 32, by clamping (the cap 32) between the two walls of this double wall which surround the pin 90. This makes it possible to avoid stresses or deformations at the point of the distribution seat (for example 94 and/or 95). In a variant, the cap 32 comprises a double wall and is fixed to the module 93 (more exactly to the tank 402) by clamping (the module 93, more exactly the tank 402) between the two walls of this double wall which surround the pin 90.

The device 400 does not include the compensation wall 89 (but may include it in a variant).

The device 400 does not include a chamber film 71.

The interior volume of the deformable chamber 2 is delimited at least in part by the cap 32.

The internal volume of the chamber 2 is delimited at least in part by the part called pressing part 37.

The internal volume of the chamber 2 is further delimited at least in part by the part called shell part 35.

The internal volume of the deformable chamber 2 is delimited at least in part by the stopper 23.

Device 400 includes both reservoir films 721, 722.

The reservoir film 721 is held in the device 400 at least in part by a force exerted by the stopper 23 on the cap 32.

The reservoir film 721 is a multilayer film, comprising for example:

- an internal thickness (on the side of the fluid contained in the reservoir 3) made of polyethylene (PE) or of ethylene-vinyl acetate (EVA), and
- an external thickness comprising a central layer of aluminum or a copolymer of ethylene and of vinyl alcohol (EVOH), this central layer being surrounded by two layers of polyethylene (PE).

The film 721 can retract in contact with the product in the tank 3.

The reservoir film 722 is integral with the cap 32.

The film 722 is in the same material as the cap 32.

The film 722 and the cap 32 form a single part without discontinuity of material.

The film 722 can hide the deformation of the film 721.

The flexibility of the film 722 is obtained by a thinner thickness than the cap 32 or the rest of the cap 32.

The end, opposite to the cap 32 and/or stopper 23, of the reservoir 3 or tube formed by each film 721, 722, is welded along one or two welding lines 56 which may be common to all films 721, 722.

Advantageously, the device 400 naturally comprises a layer of gas (preferably air) between the two films 721 and 722.

Films 721 and 722 are two tubes nested one inside the other.

The reservoir film 72, 721 is held by clamping between two walls 181, 182 of the stopper 23.

The two inner walls 181 and outer 182 are concentric and each form a closed loop.

It is the force exerted by the stopper 23 on the cap 32 (and vice versa) which clamps towards one another the two walls 181, 182 between which is disposed a part of the film 721 which thus allows the film to be held. 721.

The wall 181 is integral with the wall 182.

The wall 181 is in the same material as the wall 182.

The wall 181 and the wall 182 form a single part without discontinuity of material.

The module 93 (as shown) or the cap 32 (not shown) comprises a protruding part which surrounds the pin 90 and which emerges outside the cap 32 so as to come into contact:

- with a front (flexible) part 405 (with respect to this projecting part) of the cover 83 when the cover 83 is closed
- with a side skirt 406 (with respect to this projecting part) of the cover 83 when the cover 83 is closed.

In the case of welded thin wall 722 (avoiding a stopper), the reservoir film 721 can protrude from the cap 32, 722 and then be welded and pressed into the cap 32, after filling the reservoir 3, by sliding the stopper 23 (for example between 1 and 2 centimeters) forward in the direction 25. In this case, there are 2 positions of the pinch element a protruding first position and then a retracted position, preferably a more retracted position the clamping can then be stronger. In this case to pass a tool there is a spacer (comprising fins 401 of the stopper 23 in contact with the cap 32, 35 and emerging preferably from the outer wall 182) arranged to space the films 721 and 722 as shown in FIG. 18 in order to allow the wall 721 to be pushed towards inside of the cap 32.

The film 722 is preferably drilled (eg, by laser drill) to allow air passage between the two films 721 and 722.

In a variant, the device 400 comprises only the film 721 but not 722 or the film 722 but not the film 721.

Note that in the device 400, as each of the previously described embodiments 100 to 300, each pressing surface 37 is arranged to receive a pressing force called lateral, and that the outlet 24 is arranged to dispense fluid in a distribution direction perpendicular or substantially perpendicular to each pressing force.

Note that the device 400, as each of the previously described embodiments 200 to 300, has an elongate shape extending between two ends, and that:

each pressing surface 37 is disposed laterally between these two ends, and the outlet 24 is disposed at one of these ends.

Referring to FIG. 18, the stopper 23 is arranged to slide inside the cap 32, with a sealing junction between the stopper and the cap, over a length of at least 5 mm and even at least 6 mm and even at least 10 mm and even at least 15 mm.

With reference to FIG. 18, the chamber 2 (more exactly the module 93) comprises a chamber channel 320 which starts at the intersection of the end face 319 of the wall of the chamber 2 and the projecting part 305.

The dispensing seat is in the chamber channel 320 or at most 1 mm after the chamber channel 320.

With reference to FIGS. 19 and 20, a device 500 of a fifth embodiment according to the invention of fluid dispenser will now be described.

This embodiment 500 will only be described for its differences with respect to the fourth mode 400 of FIGS. 17 and 18.

This variant device 500 comprises the valve 4 previously described.

The walls 181 and 182 may be in the same material or in different materials.

The wall 181 and the wall 182 form two distinct parts with a discontinuity of material between the wall 181 and 182.

This stopper 23 is completely enclosed inside a case comprising:

the cap 32 a base 321 attached to the cap 32 (for example screwed or clipped to the cap 32)

The tube 500 has the base 321 of the case which can be clipped to the cap 32 (not shown) or to the stopper 23. Side buttons 501 (flexible) preferably formed in overmolding or dual injection with the deformable wall 37 can hide the clips 502. These clips 502 can be made on the stopper 23.

The cap 32 comprises feet 508 arranged to place the device 500 upright with its inlet 24 downwards.

The stopper 23 comprises a perforator 505 arranged to pierce a lid of the reservoir 3 pressed into the stopper 23 so that the operculum thus pierced forms the inlet 38.

A cartridge formed by the film 72, 721 and a lid may be driven and pierced on the stopper 23, more precisely by the perforator 505.

The filling for the first cartridge can be performed for the mounted cartridge then:

a nozzle 503 is applied to an appendix 504, then after a vacuum, filling the cartridge is practiced and then a welding of the appendix 504 is carried out. Preferably the welding is done before the disconnection of the nozzle 503 in order to limit the entry of air.

Once primed the cartridge 72, 721 can be replaced without secondary priming We reference to FIG. 21, a variant of the fifth embodiment of the device 500 according to the invention of fluid dispenser will be described.

This variant will only be described for its differences with respect to the device 500 of FIGS. 19 and 20.

The wall 181 is integral with the wall 182.

The wall 181 is in the same material as the wall 182.

The wall 181 and the wall 182 form a single part without discontinuity of material.

The film 721 forms a tube and is held:

at one of its ends by clamping at least partly by a force exerted by the stopper 23 on the cap 32 and at the other end by a bottom 506 provided with the filling hole 504, this bottom 506 being typically welded or pinched (here pinched in FIG. 21) to the film 721.

As previously for a previous embodiment, this variant device 500 comprises, for passing a tool, a spacer element (comprising fins 401 of the stopper 23 in contact with the cap 32, 35 and emerging preferably from the outer wall 182) arranged to space the films 721 and 722 as shown in FIG. 21 in order to allow the wall 721 to be pushed towards the inside of the cap 32.

Of course, the invention is not limited to the examples which have just been described and many adjustments can be made to these examples without departing from the scope of the invention:

the film 71 (as shown in FIG. 2) and/or the contact line or lines as described with reference to FIGS. 10 and 11 and/or the compensation wall 89 are preferably also present in each of the variants of the first embodiment of FIGS. 1 to 5, and/or like the first embodiment 100, a variant of the second mode 200 or fourth mode 400 or fifth mode 500 may comprise several gas pockets 92, preferably aligned along the direction of elongation and/or displacement of the rod 90 or pin 90, and/or in each of the variants or embodiments previously described, the compensation wall 89 may be a wall of a gas pocket 92 independent of each gas pocket 92 delimited by a movable wall 91, and/or as shown in FIG. 13, in each of the variants or embodiments previously described, the wall 81 and/or 82 may comprise relief patterns (such as for example teeth or anti-return rings) in contact with the film of reservoir 722. This gives a gripping and slip-resistant effect to the film 722, and/or in each of the variants or embodiments described above, the at least one return means 96 may be replaced and/or supplemented by the gas inside one or more pockets 92 and compressed to a pressure greater than one atmosphere, and/or in each of the previously described embodiments comprising a module 93, a compensating element 89 as described with reference to the device 200 may also be present, this element 89 being preferably integrated in the module 93, either in the form of a flexible wall at the rear of the module 93 or an extension (for example lateral) of the wall 91, and/or each of the embodiments described above can be adapted to several reservoirs 3 (having for example a common wall) and/or several outlets 24 and/or several fluid circulation paths (with common outlet 24 or different outlets 24), and/or in general, it will be noted, with reference to the previously described embodiments and to their different possible variants, that the device according to the invention may comprise at least one (two or more preferably at least two) reservoir film 72 among:

a reservoir film 721 and/or 722 held in the device according to the invention by clamping between the stopper 23 and the cap 32, and/or a reservoir film 721 and/or 722 held in the device according to the invention by clamping between the stopper 23 and any other part (for example 321 or a clamping ring inside the stopper 23), and/or a reservoir film 721 and/or 722 held in the device according to the invention by clamping between the cap 32 and any other part (for example a clamping ring external to the cap 32), and/or a reservoir film 721 held in the device according to the invention by clamping at least in part by a force exerted by the stopper 23 on the cap 32, and/or a reservoir film 721 secured to the part of the stopper 23 carrying the inlet 38 and/or in the same material as the part of the stopper 23 carrying the inlet 38 and/or forming a single part without discontinuity of material with the part of the stopper 23 carrying the inlet 38 (in particular in a variant of FIG. 17, 19, 21 or 22) as shown in FIG. 22, and/or a reservoir film 722 held in the device according to the invention by clamping at least in part by a force exerted by the stopper 23 on the cap 32 (in particular in a variant of FIG. 17), and/or a reservoir film 722 integral with the cap 32 and/or in the same material as the cap 32 and/or forming a single part without discontinuity of material with the cap 32.

Of course, the various features, shapes, variants and embodiments of the invention may be associated with each other in various combinations to the extent that they are not incompatible or exclusive of each other. In particular all the variants and embodiments described above are combinable with each other.

The invention claimed is:

1. A dispensing device, comprising:

a deformable chamber whose interior volume is arranged to contain a fluid, said chamber being provided with an inlet so that the device is arranged to conduct a fluid along a circulation path of fluid from the inlet then through the chamber and to an outlet;

a dispensing valve which, in an open state, allows a passage of fluid from the interior of the chamber towards outside of the device through the outlet of the chamber, and, in a closed state, does not allow it, wherein the dispensing valve comprises a pin and a movable member, the pin having an end which:

in the closed state of the dispensing valve, closes the outlet of the chamber and in the open state of the dispensing valve, moves away from the outlet of the chamber, the movable member being arranged to move under the effect of a decrease of the interior volume of the chamber or an overpressure from the fluid in the interior volume of the chamber above a certain threshold so as to move the pin away from the outlet of the chamber so as to move the dispensing valve from its closed state to its open state the movable member comprising at least one movable wall of at least one gas pocket, the movable wall of each gas pocket having a contact surface arranged to be fully in contact with the fluid contained in the chamber, and an area of the contact surface of the gas pocket or the sum of the areas of the contact surfaces of the gas pockets being at least 50 $mm^2$.

2. The device according to claim 1, wherein each gas pocket containing a gas being arranged to isolate this gas with respect to the fluid contained in the deformable chamber.

3. The device according to claim 2, wherein each gas pocket is located in the chamber.

4. The device according to claim 2, wherein the device is arranged so that the gas cannot exit from the pocket.

5. The device according to claim 1, wherein the pin and the movable member are arranged to be in contact with the fluid contained in the deformable chamber.

6. The device according to claim 1, comprising at least one return means arranged to exert on the pin a return force so as to push the pin towards the outlet of the chamber so as to return the dispensing valve from its open position to its closed position, wherein the at least one return means comprises, for the gas pocket or for at least one of the gas pockets, at least one movable wall of gas pocket and a spring inside this gas pocket and in contact with the movable wall of this gas pocket.

7. The device according to claim 1, wherein the dispensing valve is entirely within the deformable chamber in the open position of the dispensing valve.

8. The device according to claim 1, wherein the pin is flush with or projects less than 1 mm from the outlet.

9. The device according to claim 1, wherein a pressing part arranged to be movable so as to modify the interior volume; and the pressing part is a flexible surface.

10. The device according to claim 1, wherein the gas pocket containing a gas being arranged to isolate this gas from the fluid contained in the deformable chamber.

11. The device according to claim 1, wherein at least one or each contact surface is convex on a side of the fluid contained in the deformable chamber.

12. A dispensing device, comprising:

a deformable chamber, an interior volume of which is arranged to contain a fluid, the deformable chamber being provided with an outlet, a dispensing valve which, in an open state, allows fluid to flow from the interior of the chamber to the outside of the device through the outlet of the chamber and, in a closed state, does not allow it, the dispensing valve comprising a pin and a movable member, the pin having an end that:

in the closed state of the dispensing valve, closes the outlet of the chamber and in the open state the dispensing valve moves away from the outlet of the chamber the movable member being arranged to move under the effect of a decrease in the interior volume of the chamber or an overpressure of the fluid in the interior volume of the chamber above a certain pressure threshold so as to move the pin by moving it away from the outlet of the chamber so as to move the dispensing valve from its closed state to its open state, the movable member includes at least one movable wall of at least one gas pocket, wherein the dispensing valve is:

partially included inside the deformable chamber in the closed position of the dispensing valve, and/or fully included inside the deformable chamber in the open position of the dispensing valve.

13. The device according to claim 12, wherein at least one return is arranged to exert a return force on the pin so as to push the pin in the direction of the outlet of the chamber, so as to return the dispensing valve from its open position to its closed position.

14. A dispensing device, comprising:

a deformable chamber, an interior volume of which is arranged to contain a fluid, the deformable chamber being provided with an outlet, a dispensing valve which, in an open state, allows passage of fluid from the interior of the chamber to the exterior of the device through the outlet of the chamber and, in a closed state, does not, the dispensing valve comprising a pin and a movable member, the pin having an end that:

in the closed state of the dispensing valve, close the outlet of the chamber and in the open state the dispensing valve moves away from the outlet of the chamber the movable member being arranged to move under the effect of a decrease in the interior volume of the chamber or an overpressure of the fluid in the interior volume of the chamber above a certain pressure threshold so as to move the pin by moving it away from the outlet of the chamber so as to move the dispensing valve from its closed state to its open state, the outlet being delimited by a periphery comprising a so-called flexible part;

in the closed position of the dispensing valve, the end of the pin being in contact with the flexible part along a first line of contact;

wherein the pin is more rigid than the flexible part of the outlet.

15. The device according to claim 14, wherein the outlet is delimited by the periphery comprising the so-called flexible part and a so-called rigid part in a material more rigid than the flexible part, the rigid part being closer to the outside of the deformable chamber than the flexible part, the pin being more rigid than the flexible part of the outlet and than the rigid part.

16. A dispensing device, comprising:

a deformable chamber, an interior volume of which is arranged to contain a fluid, the deformable chamber being provided with an outlet, a dispensing valve which, in an open state, allows passage of fluid from the interior of the chamber to the exterior of the device through the outlet of the chamber and, in a closed state, does not, the dispensing valve being part of a module that fits into the device from outside or inside the device.

17. The device according to claim 16, wherein the module or the chamber comprises a projecting part in the direction of the outlet and extending over a length of at least 3 mm.

18. The device according to claim 16, wherein the dispensing valve comprises a pin and a movable member, the pin having an end that:

in the closed state of the dispensing valve, close the outlet of the chamber and in the open state the dispensing valve moves away from the outlet of the chamber, the movable member being arranged to move under the effect of a decrease in the interior volume of the chamber or an overpressure of the fluid in the interior volume of the chamber above a certain pressure threshold so as to move the pin by moving it away from the outlet of the chamber so as to move the dispensing valve from its closed state to its open state.

19. The device according to claim 18, wherein the module comprises a tank attached to the rest of the device.

20. The device according to claim 18, wherein the movable member comprises at least one movable wall of at least one gas pocket, each gas pocket containing a gas and being arranged to isolate this gas from the fluid contained in the deformable chamber.

21. The device according to claim 20, wherein the dispensing valve and also the at least one gas pocket are part of the module inserting into the device from outside or inside the device.

22. The device according to claim 18, wherein the chamber is provided with an inlet so that the device is arranged to lead the fluid along a path of circulation of fluid to from the entrance then through the chamber then to the exit, the entrance can optionally be fitted of a supply valve, and in that there is no valve on the fluid flow path between:

the inlet and/or the supply valve, and the distribution valve.

* * * * *